US010294827B2

(12) United States Patent
Yokoyama et al.

(10) Patent No.: US 10,294,827 B2
(45) Date of Patent: May 21, 2019

(54) VARIABLE VALVE MECHANISM FOR ENGINE

(71) Applicant: TOYOTA JIDOSHA KABUSHIKI KAISHA, Toyota-shi, Aichi-ken (JP)

(72) Inventors: Yu Yokoyama, Okazaki (JP); Atsuhisa Tamano, Anjo (JP); Toshiyuki Yano, Nagakute (JP); Soichiro Suga, Toyota (JP); Yuta Nishimura, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/830,088

(22) Filed: Dec. 4, 2017

(65) Prior Publication Data

US 2018/0179920 A1 Jun. 28, 2018

(30) Foreign Application Priority Data

Dec. 26, 2016 (JP) ..... 2016-250738

(51) Int. Cl.

| | |
|---|---|
| ***F01L 1/047*** | (2006.01) |
| ***F01L 1/053*** | (2006.01) |
| ***F01L 1/20*** | (2006.01) |
| ***F01L 13/00*** | (2006.01) |
| *F01L 1/18* | (2006.01) |

(52) U.S. Cl.

CPC ..... *F01L 1/053* (2013.01); *F01L 1/20* (2013.01); *F01L 13/0036* (2013.01); *F01L 1/185* (2013.01); *F01L 2001/0473* (2013.01); *F01L 2001/0537* (2013.01); *F01L 2013/0052* (2013.01); *F01L 2013/101* (2013.01); *F01L 2105/00* (2013.01); *F01L 2810/02* (2013.01)

(58) Field of Classification Search

CPC ..... F01L 2001/0473; F01L 2001/0476; F01L 1/053; F01L 1/267; F01L 1/46; F01L 2013/0052; F01L 2810/02; F01M 9/102; F01M 9/105; F01M 11/02

USPC ..... 123/90.18, 90.27, 90.34

See application file for complete search history.

(56) References Cited

U.S. PATENT DOCUMENTS

| | | | | |
|---|---|---|---|---|
| 2011/0180027 | A1 | 7/2011 | Hartlieb et al. | |
| 2014/0034404 | A1* | 2/2014 | Schmidt | F16F 15/126 180/230 |
| 2017/0284241 | A1* | 10/2017 | Kataoka | F01L 1/022 |

FOREIGN PATENT DOCUMENTS

| | | |
|---|---|---|
| JP | 2009-114875 | 5/2009 |
| JP | 2011-524482 | 9/2011 |

* cited by examiner

*Primary Examiner* — Jorge L Leon, Jr.

(74) *Attorney, Agent, or Firm* — Oblon, McClelland, Maier & Neustadt, L.L.P.

(57) ABSTRACT

A variable valve mechanism includes a camshaft and a cam unit. Internal spline teeth provided at an inner periphery of a sleeve of the cam unit are in mesh with external spline teeth provided at an outer periphery of the camshaft. An engaging portion is provided at one of the inner periphery of the sleeve and the outer periphery of the camshaft, and is configured to retractably project toward the other one of the inner periphery of the sleeve and the outer periphery of the camshaft. A latching portion is provided at the other one of the inner periphery of the sleeve and the outer periphery of the camshaft. The sleeve has a through-hole that is provided at the same position in a circumferential direction as the engaging portion to supply the inner periphery of the sleeve with lubricating oil.

7 Claims, 8 Drawing Sheets

VARIABLE VALVE MECHANISM FOR ENGINE

INCORPORATION BY REFERENCE

The disclosure of Japanese Patent Application No. 2016-250738 filed on Dec. 26, 2016 including the specification, drawings and abstract is incorporated herein by reference in its entirety.

BACKGROUND

1. Technical Field

The disclosure relates to a variable valve mechanism that is used in a valve actuating system of an engine and, more particularly, to a cam-changing variable valve mechanism configured to cause a cam unit, fitted around a camshaft, to slide in an axial direction (hereinafter, also referred to as cam axial direction).

2. Description of Related Art

There is known a cam-changing variable valve mechanism as a variable valve mechanism that is able to change the lift characteristic of each intake valve of an engine, as described in, for example, Published Japanese Translation of PCT application No. 2011-524482 (JP-A-2011-524482). In the cam-changing variable valve mechanism, a cam carrier (hereinafter, referred to as cam unit) including a plurality of cams is fitted around a camshaft. The cam-changing variable valve mechanism is configured to set any one of the cams by sliding the cam carrier in the axial direction. In this example, each intake valve of each cylinder of the engine is driven by the any one of the cams via a corresponding rocker arm.

Each cam unit is fitted around an intake camshaft and is spline-coupled to the intake camshaft. Each cam unit includes a mechanism (dent device) for positioning the cam unit at two locations in the axial direction of the camshaft. In this mechanism, a dent ball (engaging portion) accommodated in a blind hole that is open at the outer periphery of the camshaft is provided so as to be able to project toward the inner periphery of the facing cam unit, and is pressed into any one of annular latching grooves provided at the inner periphery of the cam unit in correspondence with the two locations.

SUMMARY

Incidentally, if a positioning mechanism is provided between each cam unit and the camshaft as in the case of the existing example, lubrication of the mechanism matters. That is, for example, in the case of the above-described dent mechanism, the dent ball slips out from any one of the two latching grooves and fits into the other one of the latching grooves each time the cam unit slides, so there is a concern about abrasion of the dent ball and latching grooves.

In terms of this point, a structure for spraying engine oil (lubricating oil) to the camshaft of the engine with the use of a shower pipe is known. However, if each cam unit is fitted around the camshaft as described above and the positioning mechanism is provided between the camshaft and each cam unit, lubrication can be insufficient unless a structure for actively supplying engine oil to the positioning mechanism is provided. There is also known a structure that an oil supply passage is provided in the camshaft in itself; however, with the structure that each cam unit is fitted around the camshaft as described above, the camshaft becomes narrow accordingly. Therefore, if an oil supply passage is tried to be provided inside the camshaft, the strength of the camshaft may not be ensured.

In consideration of such a situation, the disclosure provides stable supply of lubricating oil to a positioning mechanism provided between each cam unit and a camshaft in the above-described cam-changing variable valve mechanism.

An aspect of the disclosure provides a variable valve mechanism mounted on an engine. The variable valve mechanism includes a camshaft and a cam unit fitted around the camshaft. The cam unit includes a plurality of cams. Any one of the plurality of cams is configured to be selected by causing the cam unit to slide in an axial direction. Internal spline teeth provided at an inner periphery of a sleeve of the cam unit are in mesh with external spline teeth provided at an outer periphery of the camshaft. An engaging portion is provided at one of the inner periphery of the sleeve and the outer periphery of the camshaft, the engaging portion is configured to retractably project toward the other one of the inner periphery of the sleeve and the outer periphery of the camshaft. A latching portion is provided at the other one of the inner periphery of the sleeve and the outer periphery of the camshaft, the latching portion is configured to latch the engaging portion. The sleeve has a through-hole provided at the same position in a circumferential direction as the engaging portion, the through-hole is configured to supply the inner periphery of the sleeve with lubricating oil that is supplied to an outer periphery of the sleeve.

With the thus configured variable valve mechanism, it is possible to select any one of the plurality of cams by causing the cam unit, fitted around the camshaft, to slide in the axial direction. When the cam unit is caused to slide in this way, the engaging portion provided at one of the inner periphery of the sleeve and the outer periphery of the camshaft is latched by the latching portion provided at the other one of the inner periphery of the sleeve and the outer periphery of the camshaft. Thus, the cam unit is positioned with respect to the camshaft.

The sleeve has the through-hole configured to supply the inner periphery of the sleeve with lubricating oil supplied to the outer periphery of the sleeve, so it is possible to actively supply lubricating oil to the engaging portion and the latching portion. Since the through-hole is provided at the same position in the circumferential direction of the sleeve as the engaging portion, lubricating oil supplied from the through-hole to the inner periphery of the sleeve is guided in the axial direction by the internal spline teeth, and is supplied to the engaging portion. The sleeve and the camshaft are held in the same phase by splines.

The engine may include a plurality of cylinders. In this case, the sleeve may extend over the adjacent two cylinders and integrally constitute the cam units for the two cylinders, and a journal portion that is held by a cam holder may be provided between the two cylinders. The through-hole may be provided in the journal portion to communicate with a circumferential groove that opens to an inner periphery of the cam holder. Thus, lubricating oil is supplied from the groove.

The engaging portion may be provided on the sleeve or the camshaft at two locations spaced apart from each other in the circumferential direction, and the through-hole may be provided at two locations spaced apart from each other in the circumferential direction in correspondence with the two locations at which the engaging portion is provided. With this configuration, lubricating oil is supplied from the circumferential groove of the cam holder to the inner periphery of the sleeve via the two through-holes, so it is possible to further stably supply lubricating oil to the engaging portions.

In the variable valve mechanism, the latching portion may be an annular groove provided all around the camshaft or the sleeve. With this configuration, lubricating oil supplied to any one of the two engaging portions is also supplied to the other one of the two engaging portions via the annular groove. In this case, the two through-holes may be provided so as to deviate from each other in the axial direction of the camshaft.

That is, one of the through-holes is deviated to the other side of the camshaft in the axial direction with respect to the other one of the through-holes. Thus, the area of communication of one of the through-holes with the circumferential groove increases at the time when the cam unit has slid to one side in the axial direction, whereas the area of communication of the other one of the through-holes with the circumferential groove increases at the time when the cam unit has slid to the other side in the axial direction. With this configuration, even when the cam unit has slid to any side in the axial direction, a sufficient passage area is easily ensured.

In the variable valve mechanism, the two through-holes may be provided so as to partially overlap each other in the axial direction of the camshaft. With this configuration, it is possible not to excessively increase the size in the axial direction as a whole while the two through-holes deviate from each other as described above. With this configuration, since the through-holes are difficult to run out from the groove of the cam holder at the time when the cam unit has slid, leakage of lubricating oil tends to be suppressed.

In the variable valve mechanism, the amount of deviation between the two through-holes may be smaller than half of a size of each of the through-holes in the axial direction.

In the variable valve mechanism, at least any one of the two through-holes may constantly communicate with the circumferential groove.

According to the aspect of the disclosure, in the cam-changing variable valve mechanism in which the cam unit fitted around the camshaft is spline-coupled to the camshaft and the cam unit is caused to slide in the axial direction, when the positioning mechanism consisting of the engaging portion and the latching portion is provided between the sleeve of the cam unit and the camshaft, the through-hole for supplying lubricating oil to the sleeve is provided at the same position in the circumferential direction as the engaging portion. Thus, it is possible to stably supply lubricating oil to the engaging portion and, by extension, the positioning mechanism.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
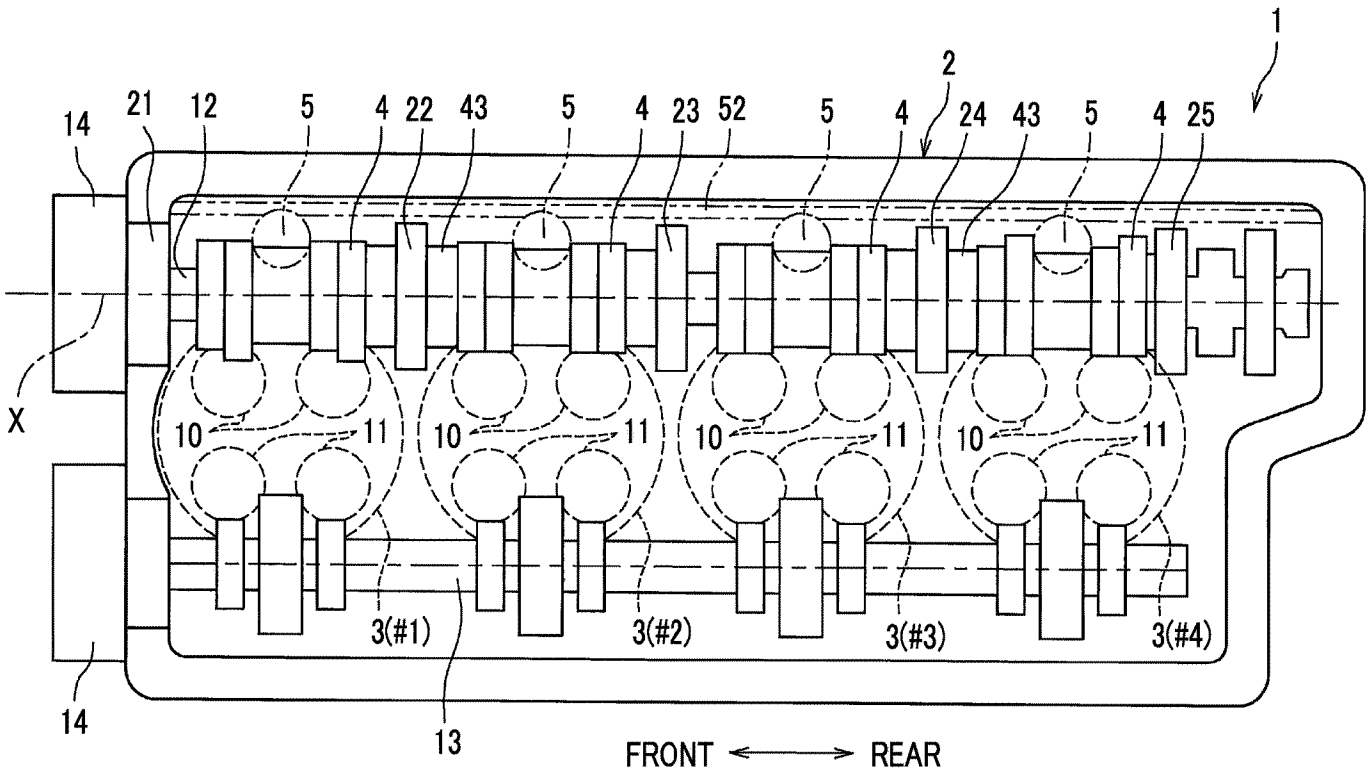
FIG. 1 is a schematic configuration view of a valve actuating system for an engine in which a variable valve mechanism according to an embodiment of the disclosure is provided.

Hereinafter, an embodiment in which the disclosure is applied to a valve actuating system for an engine will be described. The engine 1 according to the present embodiment is, for example, an in-line four-cylinder gasoline engine 1. As schematically shown in FIG. 1, four first to fourth cylinders 3 (#1 to #4) are arranged in the longitudinal direction of a cylinder block (not shown), that is, the front-to-rear direction (the horizontal direction of FIG. 1 indicated by the arrow) of the engine 1. In the following description, the front-to-rear direction of the engine 1 may be simply referred to as front-to-rear.

As shown from above in FIG. 1, a cam housing 2 is arranged at the upper portion (cylinder head) of the engine 1, and accommodates an intake-side valve actuating system and an exhaust-side valve actuating system. That is, as indicated by the dashed lines in FIG. 1, the two intake valves 10 and the two exhaust valves 11 are provided for each of the four cylinders 3 arranged in line in the front-to-rear direction of the engine 1. The intake valves 10 are driven by an intake camshaft 12. The exhaust valves 11 are driven by an exhaust camshaft 13. A variable valve timing (VVT) 14 is provided at the front end of the intake camshaft 12, and another variable valve timing (VVT) 14 is provided at the front end of the exhaust camshaft 13.

Figure 2:
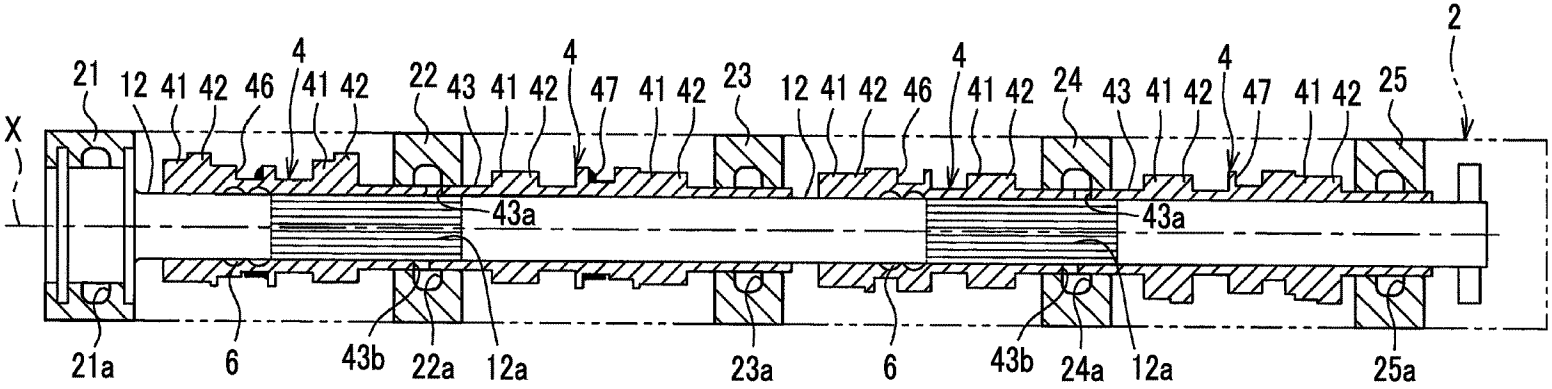
FIG. 2 is a longitudinal sectional view that shows the configuration of cam units fitted around an intake camshaft.

The intake camshaft 12 is also shown in FIG. 2. For example, as also shown in FIG. 2, the cam housing 2 includes five cam holders 21 to 25 in correspondence with a location between the front end of the intake camshaft 12 and the frontmost cylinder, locations between cylinders and a location between the rearmost cylinder and the rear end of the intake camshaft 12. The cam holders 21 to 25 respectively support five journal portions of the intake camshaft 12 such that the journal portions are rotatable. That is, the first cam holder 21 at the frontmost portion (left end in FIG. 2) supports the first journal portion provided in a front piece of the intake camshaft 12.

On the other hand, the four second to fifth journal portions other than the first journal portion are provided not in the intake camshaft 12 in itself but in sleeves 43 fitted around the intake camshaft 12 as will be described in detail later, and are respectively supported by the second to fifth cam holders 22 to 25. Oil supply grooves 21*a* to 25*a* respectively extend in the circumferential direction at the inner peripheries of those cam holders 21 to 25. Engine oil (lubricating oil) is supplied to the oil supply grooves 21*a* to 25*a* via an oil passage (not shown).

Figure 3:
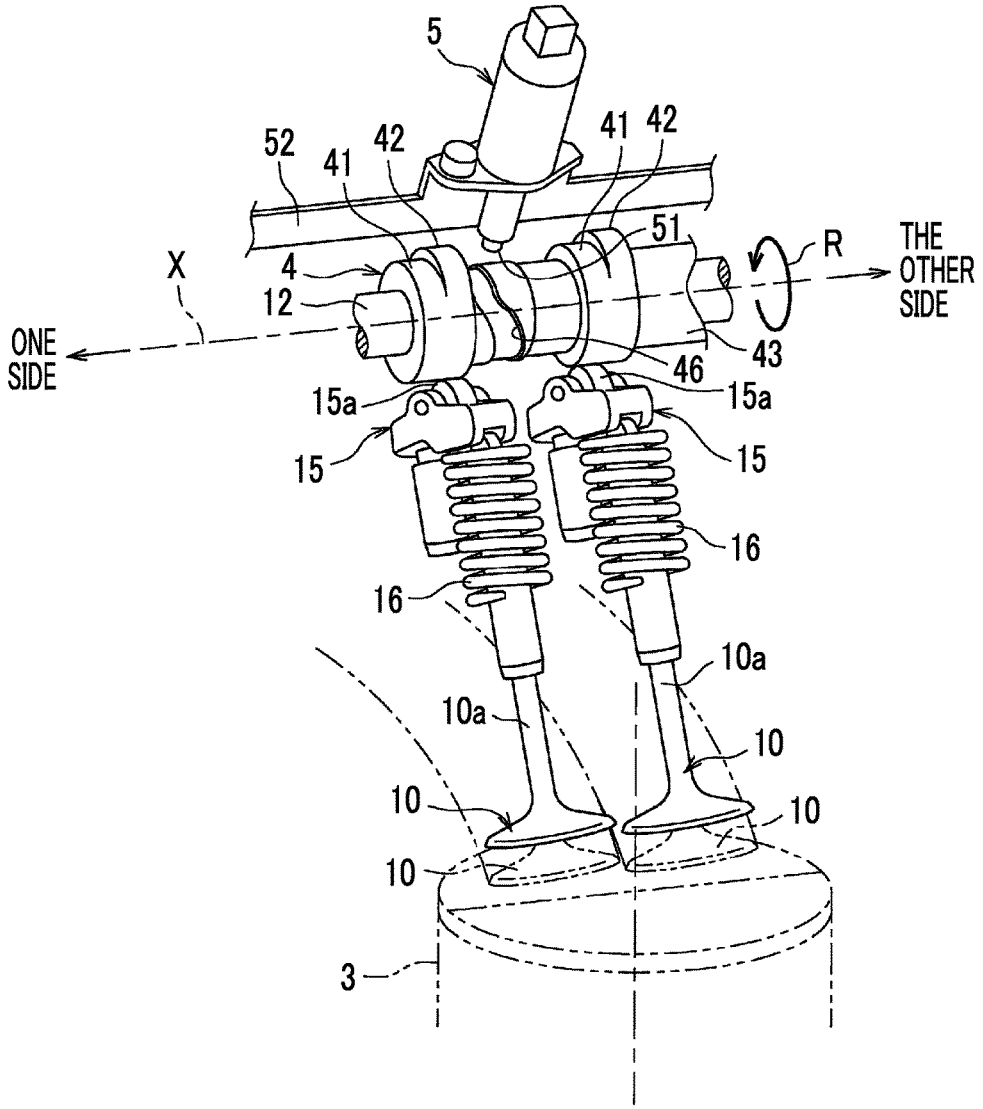
FIG. 3 is a perspective view that shows the configuration of an intake-side valve actuating system for a first cylinder.

A cam changing mechanism (variable valve mechanism according to the aspect of the disclosure) is provided on the intake camshaft 12 as the characterized portion of the disclosure. Each cam changing mechanism changes the lift characteristic of a corresponding one of the intake valves 10 by changing cams 41, 42 for driving the intake valve 10. For example, the first cylinder 3 (#1) is shown in FIG. 3 in enlarged view. As shown in the drawing, the two cams 41, 42 having different profiles are provided in correspondence with each of the two intake valves 10 arranged in the direction of the axis X of the intake camshaft 12 (cam axial direction, engine front-to-rear direction) for each cylinder 3.

The low-lift cam 41 and the high-lift cam 42 are arranged from the left (one side in the axis X direction) toward the right (the other side) in FIG. 3. Any one of the low-lift cam 41 and the high-lift cam 42 is selected, and the intake valve 10 is driven via a rocker arm 15. The base circles of these low-lift cam 41 and high-lift cam 42 have the same diameter, and are formed into mutually continuous circular arc faces. FIG. 3 shows a state where the low-lift cam 41 is selected and the roller 15*a* of the rocker arm 15 is in contact with the base circle section of the low-lift cam 41.

In a state where the roller 15*a* of the rocker arm 15 is in contact with the base circle section in this way, the intake valve 10 is not lifted. That is, each intake valve 10 is a common poppet valve. A retainer is provided at the upper portion of a stem 10*a*, and receives upward pressing force from a valve spring 16. Thus, as indicated by the continuous lines in FIG. 3, the head of each intake valve 10 closes an intake port (indicated by the imaginary line).

As the intake camshaft 12 rotates in the direction indicated by the arrow R from this state, the low-lift cam 41 presses the roller 15*a* to push the rocker arm 15 downward although not shown in the drawing. Thus, the rocker arm 15 drives the intake valve 10 in accordance with the profile of the low-lift cam 41, and the intake valve 10 is lifted as indicated by the imaginary line in FIG. 3 against reaction force from the valve spring 16.

Cam Changing Mechanism

Figure 5:
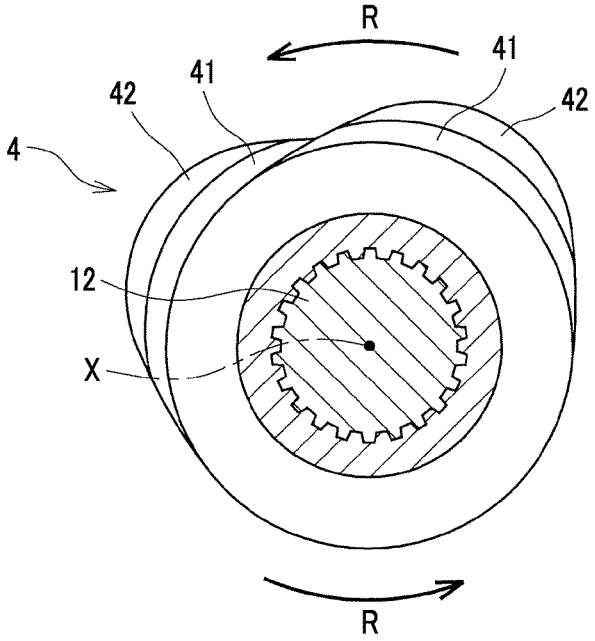
FIG. 5 is a cross-sectional view of the cam unit, and the like, taken along the line V-V in FIG. 4.
Figure 6:
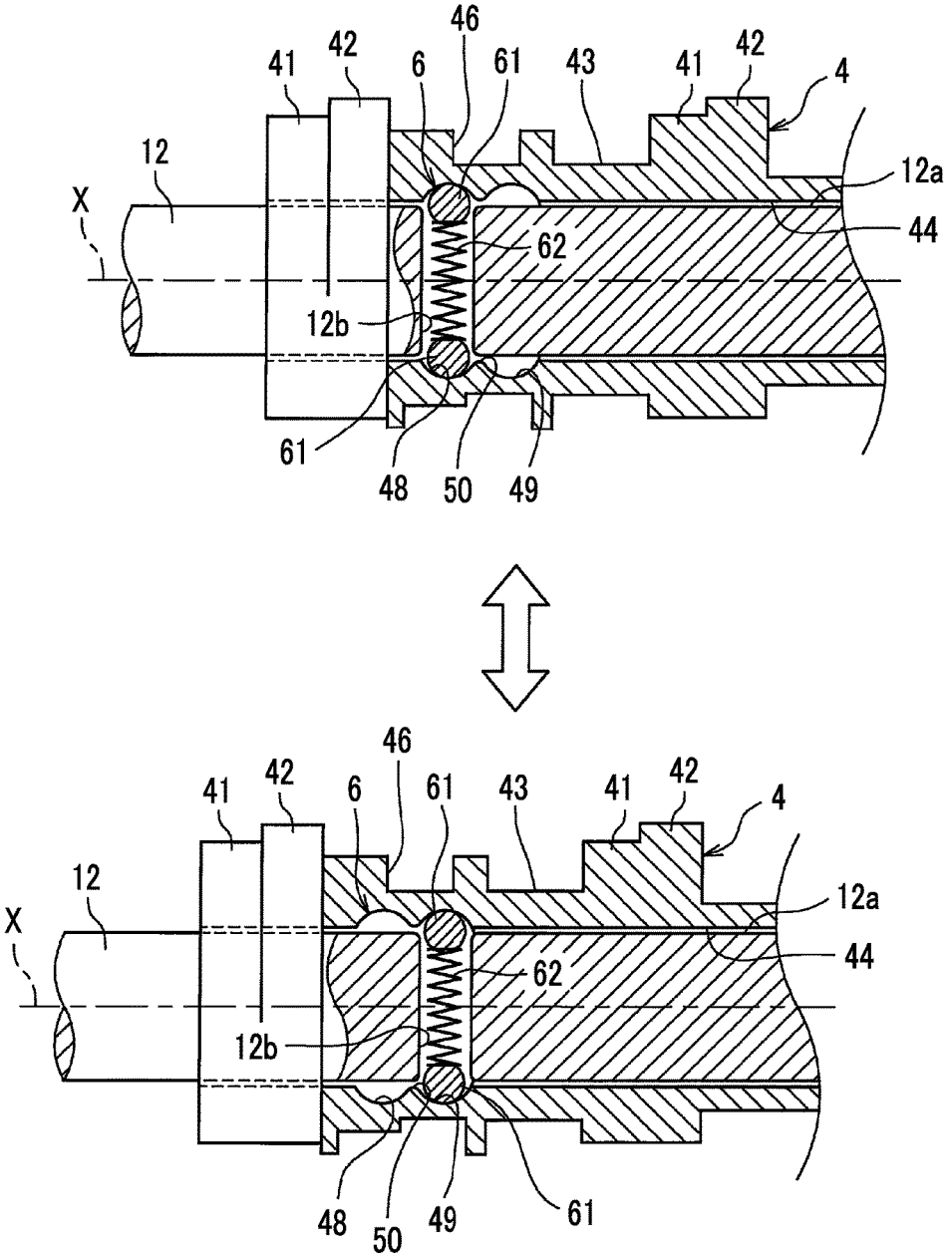
FIG. 6 is a partially sectional view for illustrating the configuration of the cam unit for the first cylinder.

In the present embodiment, the cam that lifts the intake valve 10 via the rocker arm 15 as described above is set to any one of the low-lift cam 41 and the high-lift cam 42. That is, as shown in FIG. 4 to FIG. 6 in addition to FIG. 2 and FIG. 3, in the present embodiment, the sets of two cams 41, 42 are integrally provided at predetermined locations of each cylindrical sleeve 43 to constitute the cam units 4, and each sleeve 43 is slidably fitted around the intake camshaft 12.

More specifically, as shown in FIG. 1 and FIG. 2, in the present embodiment, the long sleeve 43 extends over the first cylinder 3 (#1) and the second cylinder 3 (#2), and the sets of two cams 41, 42 are respectively provided at locations corresponding to the two intake valves 10 of each of these cylinders 3, that is, four locations in total. That is, the two cam units 4 for the first cylinder 3 (#1) and the second cylinder 3 (#2) are integrally coupled to each other. This also applies to the cam units 4 for the third cylinder 3 (#3) and the fourth cylinder 3 (#4).

Figure 4:
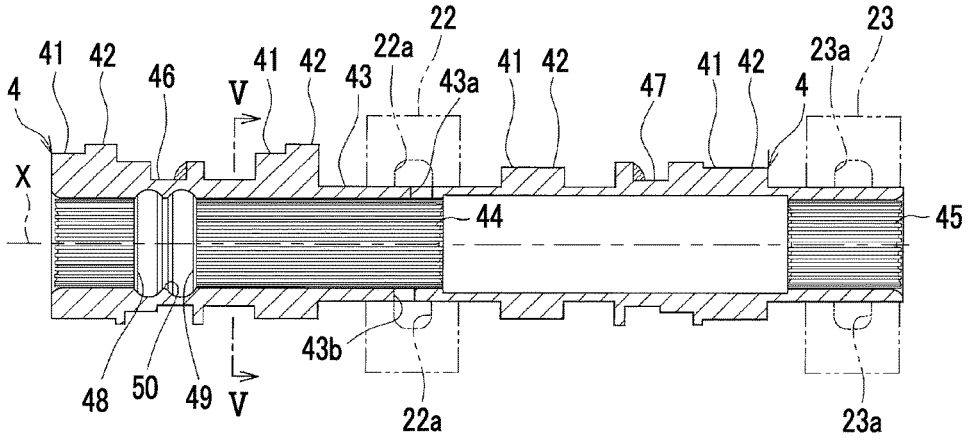
FIG. 4 is a longitudinal sectional view of the integrated two cam units.

FIG. 4 shows a longitudinal section, including the axis X, of the two cam units 4 for the first cylinder 3 (#1) and the second cylinder 3 (#2). As shown in FIG. 4, internal spline teeth 44 are provided at the inner periphery of the sleeve 43, and are in mesh with external spline teeth 12*a* provided at the outer periphery of the intake camshaft 12. That is, as shown in a cross section of FIG. 5, taken along the line V-V in FIG. 4, the cam units 4 (sleeve 43) are spline-coupled to the intake camshaft 12, and are configured to rotate integrally with the intake camshaft 12 and slide in the direction of the axis X.

As shown in FIG. 4, in the present embodiment, the internal spline teeth 44 are provided at the inner periphery of the sleeve 43 in correspondence with the first cylinder 3 (#1), while no internal spline teeth 44 are provided at a portion corresponding to the second cylinder 3 (#2) for the sake of weight reduction. Internal spline teeth 45 having the same shape and the same phase as the internal spline teeth 44 are provided at the rear end of the sleeve 43 in order to constitute a so-called tooth tip bearing.

That is, as described with reference to FIG. 2, the third journal portion that is supported by the third cam holder 23 is provided at the rear end of the sleeve 43, and the outer periphery of the third journal portion is slidably supported by the inner periphery of the third cam holder 23. The internal spline teeth 45 are provided at the inner periphery of the third journal portion. The tooth crests (inner peripheral end face) of the internal spline teeth 45 are in contact with the outer periphery of the intake camshaft 12. Thus, the third journal portion slidably supports the intake camshaft 12.

In order to cause the cam units 4 to slide, guide grooves 46, 47 are provided at the outer periphery of the sleeve 43. Corresponding shift pins 51 are engaged with the guide grooves 46, 47, as will be described below. That is, as shown in FIG. 2, FIG. 3, and the like, the clockwise spiral guide groove 46 is provided at the middle portion of the cam unit 4 for the first cylinder (#1) in the axis X direction. The guide groove 46 extends in the circumferential direction all around. Similarly, the counter-clockwise spiral guide groove 47 is provided in the cam unit 4 for the second cylinder (#2).

An actuator 5 is arranged above the intake camshaft 12 in correspondence with each of the cylinders 3 and is supported by the cam housing 2 via, for example, a stay 52 (see FIG. 1 and FIG. 2) so that each shift pin 51 can be engaged with a corresponding one of the guide grooves 46, 47. The stay 52 extends in the axis X direction. Each actuator 5 is configured to actuate a corresponding one of the shift pins 51 back and forth with the use of an electromagnetic solenoid. When the actuator 5 is in an on state, the corresponding shift pin 51 extends and engages with a corresponding one of the guide grooves 46, 47.

Cam Changing Operation

For example, when the thus extended shift pin 51 is engaged with the guide groove 46 for the first cylinder 3 (#1), the shift pin 51 relatively moves in the circumferential direction on the outer periphery of the cam unit 4 and also moves in the axis X direction along the guide groove 46 (that is, obliquely) with the rotation of the intake camshaft 12, as will be described below additionally with reference to FIG. 7 and FIG. 8. At this time, actually, the cam unit 4 slides in the axis X direction while rotating.

Figure 7:
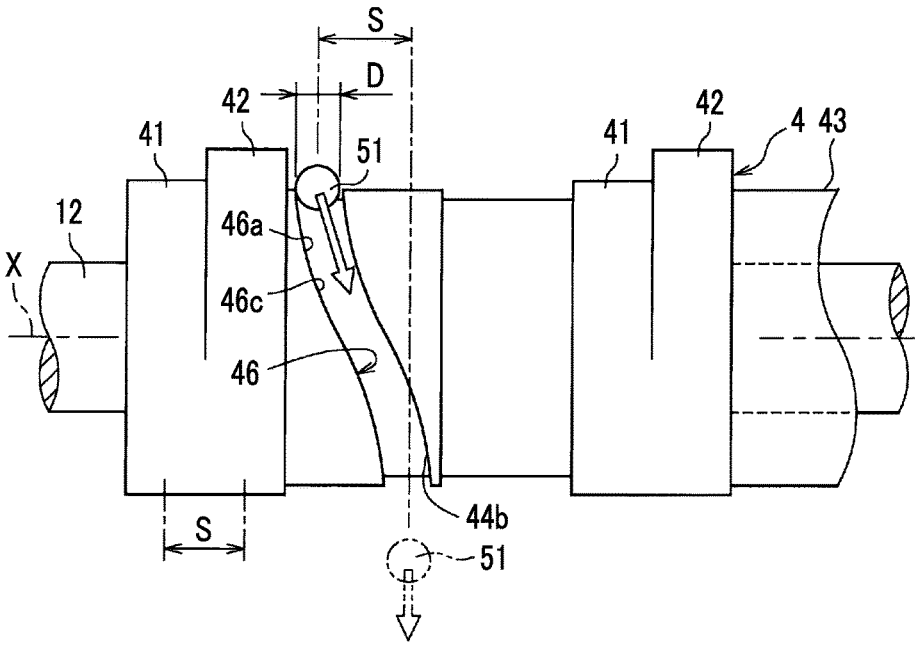
FIG. 7 is a view for illustrating the configuration of a cam changing mechanism that causes the cam unit to slide by engaging a shift pin with a guide groove.

More specifically, initially, as shown in FIG. 7, the guide groove 46 includes straight groove portions 46*a*, 46*b* and an S-shaped curved groove portion 46*c*. The straight groove portion 46*a* linearly extends in the circumferential direction at one side (left side in FIG. 7) on the outer periphery of the cam unit 4 in the axis X direction. The straight groove portion 46*b* linearly extends in the circumferential direction at the other side (right side in FIG. 7) on the outer periphery of the cam unit 4 in the axis X direction. The curved groove portion 46*c* connects these straight groove portions 46*a*, 46*b* with each other. As shown in FIG. 3, in the position in which the low-lift cam 41 is selected (low-lift position), the straight groove portion 46*a* at one side in the axis X direction faces the shift pin 51 of the actuator 5.

Figure 8:
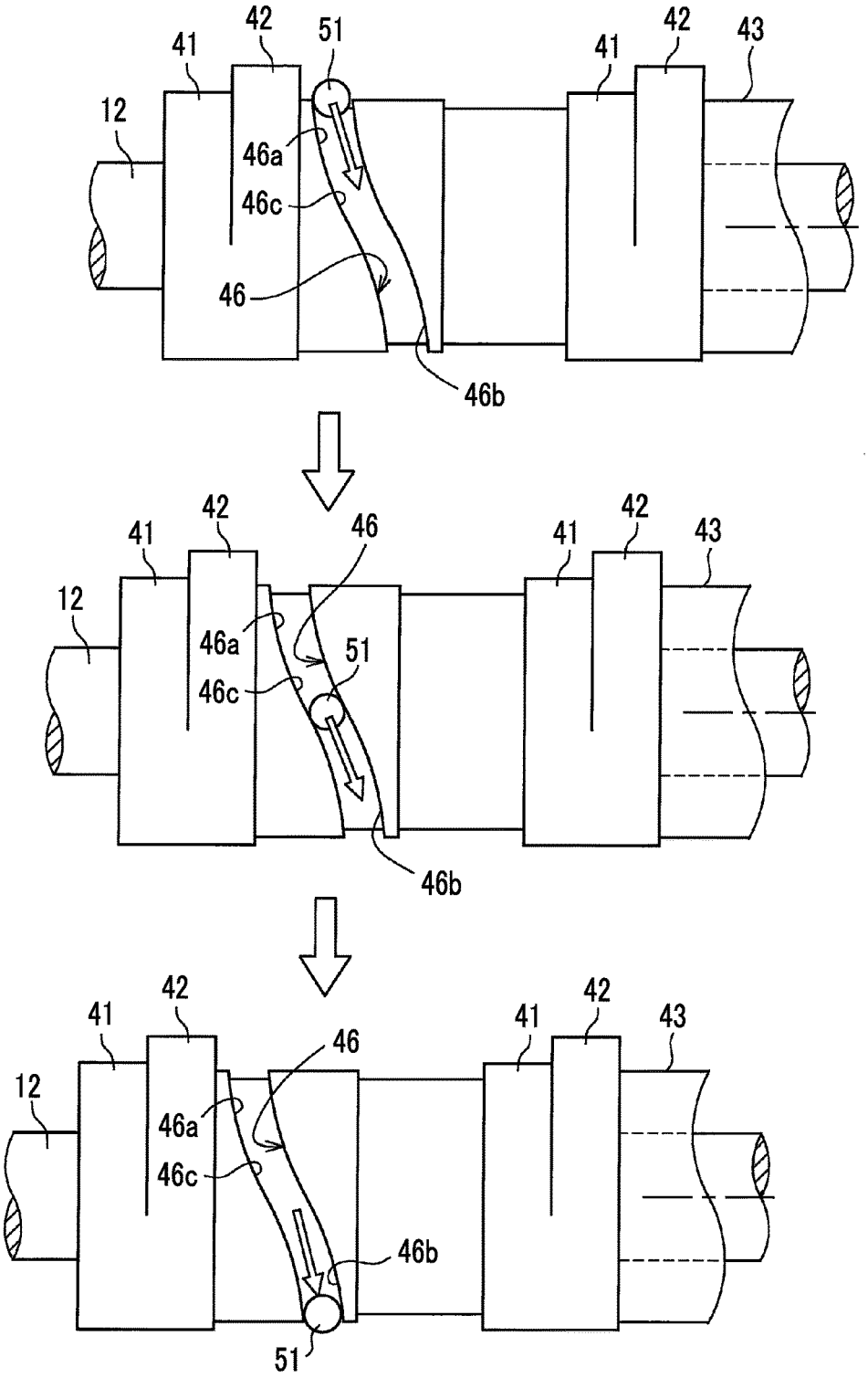
FIG. 8 is a view that illustrates the operation of the cam changing mechanism.

When the actuator 5 operates to cause the shift pin 51 to extend in this state, the shift pin 51 is engaged with the straight groove portion 46*a* located at one side of the guide groove 46 as shown in the top view of FIG. 8, and relatively moves downward in the drawing with the rotation of the intake camshaft 12. Then, as shown in the middle view of FIG. 8, the shift pin 51 reaches the curved groove portion 46*c*, and also moves to the other side in the axis X direction, that is, obliquely, while relatively moving downward in the drawing along the curved groove portion 46*c*.

Thus, actually, the shift pin 51 presses the cam unit 4 toward one side in the axis X direction to cause the cam unit 4 to slide, and switches the cam unit 4 into the position in which the high-lift cam 42 is selected (high-lift position). At this time, as shown in the bottom view of FIG. 8, the shift pin 51 reaches the straight groove portion 46*b* located at the other side of the guide groove 46, and, after that, leaves the guide groove 46. A sliding amount S of the cam unit 4 at the time of switching from the low-lift position to the high-lift position in this way is equal to the distance between the low-lift cam 41 and the high-lift cam 42 as shown in FIG. 7.

When the cam unit 4 is switched into the high-lift position as described above, the straight groove portion at the other side of the guide groove 47 in the axis X direction, provided in the cam unit 4 for the second cylinder (#2), faces the shift pin 51 of the actuator 5 although not shown in the drawing. Then, by turning on the actuator 5 to cause the shift pin 51 to engage with the guide groove 47, it is possible to cause the cam unit 4 to slide to the other side in the axis X direction with the rotation of the intake camshaft 12 and move the cam unit 4 to the low-lift position similarly.

Lock Mechanism

In the present embodiment, a lock mechanism 6 (positioning mechanism) is provided between the cam unit 4 for the first cylinder 3 (#1) and the intake camshaft 12. The lock mechanism 6 is used to hold the position of the cam unit 4 (the low-lift position or the high-lift position) at the time when the cams 41, 42 have been changed as described above. That is, as shown in FIG. 2 and FIG. 6, two annular grooves 48, 49 (latching portions) are provided all around at the inner periphery of the sleeve 43 in correspondence with the cam unit 4 for the first cylinder 3 (#1) side by side in the axis X direction (the horizontal direction in FIG. 6), and an annular protrusion 50 remains between the annular grooves 48, 49.

Two lock balls 61 (engaging portions) are retractably arranged at the outer periphery of the intake camshaft 12 so as to be fitted to the annular groove 48 or the annular groove 49 when the cam unit 4 is in the low-lift position or the high-lift position. That is, in the present embodiment, a through-hole 12*b* extends through the intake camshaft 12 and opens at two locations on the outer periphery of the intake camshaft 12. The through-hole 12*b* has a circular cross section. The through-hole 12*b* accommodates the two lock balls 61 and a coil spring 62 inside.

In other words, the lock balls 61 are arranged at two locations spaced apart by 180° from each other in the circumferential direction on the outer periphery of the intake camshaft 12. The lock balls 61 are respectively arranged on both ends of the coil spring 62, and are urged by the spring force of the coil spring 62 so as to be pushed outward from openings at both ends of the through-hole 12*b*. When the cam unit 4 is in the low-lift position (the right-side position in FIG. 6) as shown in the top view of FIG. 6, the two lock balls 61 are fitted into the annular groove 48 to restrict a slide of the cam unit 4 and hold the cam unit 4 in the low-lift position.

On the other hand, when the cam unit 4 is in the high-lift position (the lest-side position in FIG. 6) as shown in the bottom view of FIG. 6, the two lock balls 61 are fitted into the annular groove 49 to restrict a slide of the cam unit 4 and hold the cam unit 4 in the high-lift position. As described with reference to FIG. 8, when the cam unit 4, for example, slides from the low-lift position to the high-lift position, the lock balls 61 climb over the annular protrusion 50 and move from the annular groove 48 to the annular groove 49.

At this time, as the cam unit 4 slides, the lock balls 61 are initially pushed by the annular protrusion 50, move against the spring force of the coil spring 62, and slip out from the annular groove 48. After climbing over the annular protrusion 50, the lock balls 61 are fitted into the annular groove 49 under the spring force of the coil spring 62. When the cam unit 4 slides from the high-lift position to the low-lift position, the lock balls 61 leave the annular groove 49 accordingly, climb over the annular protrusion 50, and are then fitted into the annular groove 48.

Lubrication of Lock Mechanism

Incidentally, when the lock mechanism 6 is provided between each cam unit 4 and the intake camshaft 12 as described above, lubrication of the lock mechanism 6 matters. This is because, for example, when the cam unit 4 slides between the low-lift position and the high-lift position as described above, the lock balls 61 slip out from the annular groove 48 or the annular groove 49, climb over the annular protrusion 50 and are fitted into the annular groove 49 or the annular groove 48 and, therefore, there is a concern about abrasion of the lock balls 61, annular protrusion 50, and the like.

In terms of this point, generally, there is known a structure for spraying engine oil (lubricating oil) to a camshaft with the use of a shower pipe in order to lubricate a valve actuating system for an engine. However, as described above, in the present embodiment, the lock mechanism 6 is provided between the intake camshaft 12 and each cam unit 4, so lubrication can be insufficient unless a structure for actively supplying engine oil to the lock mechanism 6 is provided. In addition, since the sleeves 43 are fitted around the intake camshaft 12, the intake camshaft 12 tends to be narrow, so it is difficult to provide an oil supply passage inside the intake camshaft 12 from the viewpoint of ensuring the strength of the intake camshaft 12.

In the present embodiment, as shown in FIG. 2 and FIG. 4, each sleeve 43 has through-holes 43*a*, 43*b*, and engine oil is actively supplied to the inner periphery of the sleeve 43. That is, as described above, the cam holders 21 to 25 respectively have the oil supply grooves 21*a* to 25*a*, and engine oil is supplied to the oil supply grooves 21*a* to 25*a*. Engine oil is supplied from the oil supply grooves 21*a* to 25*a* to the outer peripheries of the journal portions of the intake camshaft 12.

As shown in FIG. 4, in the sleeve 43 corresponding to the first and second cylinders 3 (#1, #2), the through-holes 43*a*, 43*b* provided in the second journal portion between the first and second cylinders 3 communicate with the oil supply groove 22*a* of the second cam holder 22 and supply engine oil to the inner periphery of the sleeve 43. Although not shown in FIG. 4, the sleeve 43 corresponding to the third and fourth cylinders 3 (#3, #4) has through-holes 43*a*, 43*b* in the fourth journal portion.

In the present embodiment, the two through-holes 43*a*, 43*b* are provided at two locations spaced apart from each other by 180° in the circumferential direction of the sleeve 43. The sleeve 43 is fitted around the intake camshaft 12 such that the through-holes 43*a*, 43*b* are aligned at the same positions as the lock balls 61 in the circumferential direction. In other words, the through-holes 43*a*, 43*b* are provided at two locations in correspondence with the two lock balls 61.

Figure 9:
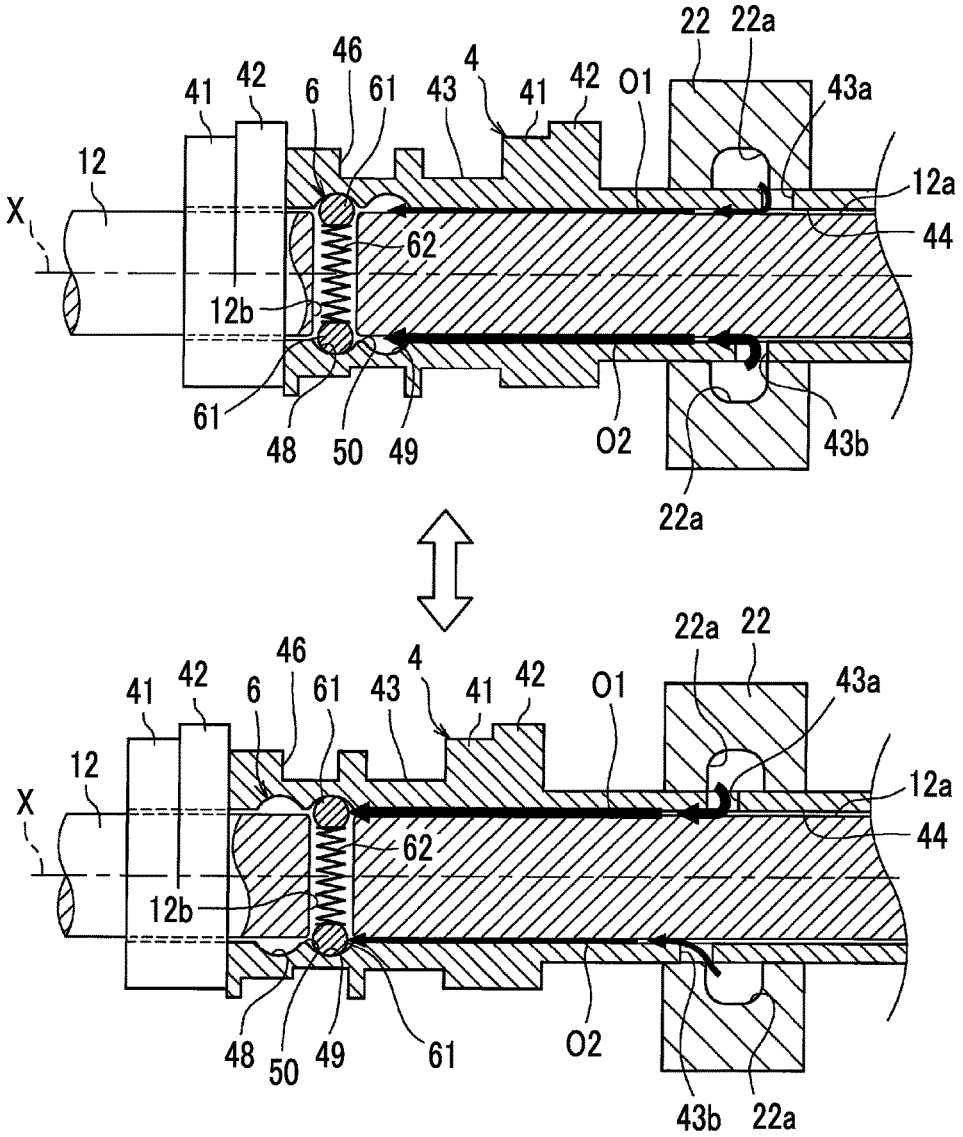
FIG. 9 is a view that illustrates the flow of engine oil to a lock mechanism and that corresponds to FIG. 4.

Thus, as indicated by the arrows O1, O2 in FIG. 9, engine oil supplied from the two through-holes 43*a*, 43*b* to the inner periphery of the sleeve 43 is guided in the axis X direction by the internal spline teeth 44 and the external spline teeth 12*a*, and is supplied to the two lock balls 61. Engine oil supplied to any one of the lock balls 61 in this way is also supplied to the other one of the lock balls 61 via the annular grooves 48, 49.

As shown in FIG. 4 and FIG. 9, one of the two through-holes 43*a*, 43*b* (the upper-side through-hole 43*a* in FIG. 9) deviates to the other side (right side in the drawing) in the axis X direction with respect to the other one of the two through-holes 43*a*, 43*b* (the lower-side through-hole 43*b*). The amount of deviation is smaller than half of the size of each of the through-holes 43*a*, 43*b* in the axis X direction, so the two through-holes 43*a*, 43*b* partially overlap each other in the axis X direction.

With this configuration, as shown in the bottom view of FIG. 9, when the sleeve 43 slides to one side in the axis X direction and the cam unit 4 is in the high-lift position, the area of communication of the through-hole 43*a* with the oil supply groove 22*a* increases, and the amount of engine oil that is supplied through this route increases (indicated by the wide arrow O1 in the drawing). At this time, the through-hole 43*b* also communicates with the oil supply groove 22*a*, and engine oil is supplied as indicated by the narrow arrow O2.

As shown in the top view of FIG. 9, when the sleeve 43 slides to the other side in the axis X direction and the cam unit 4 is in the low-lift position, the area of communication of the through-hole 43*b* with the oil supply groove 22*a* increases, and the amount of engine oil that is supplied from this route increases as indicated by the wide arrow O2 in the drawing. At this time, the through-hole 43*a* also communicates with the oil supply groove 22*a*, and engine oil is supplied as indicated by the narrow arrow O1.

That is, since the two through-holes 43*a*, 43*b* deviate from each other in the axis X direction, the area of an oil passage with the oil supply groove 22*a* is sufficiently ensured by any one of the through-holes 43*a*, 43*b* in both the low-lift position and the high-lift position, and the amount of engine oil that is supplied to the lock balls 61 sufficiently increases. Since engine oil flows through the annular grooves 48, 49, engine oil is sufficiently supplied to both the two lock balls 61.

In addition, since the through-holes 43*a*, 43*b* deviate in the axis X direction while partially overlapping each other, the overall size of these through-holes 43*a*, 43*b* in the axis X direction does not excessively increase. For this reason, projection of each of the through-holes 43*a*, 43*b* from the oil supply groove 22*a* at the time when the sleeve 43 has been caused to slide to one side or the other side in the axis X direction is reduced.

That is, for example, forward projection of the through-hole 43*b* from the oil supply groove 22*a* at the time when the sleeve 43 has slid to one side in the axis X direction as shown in the bottom view of FIG. 9 is reduced. Rearward projection of the through-hole 43*a* from the oil supply groove 22*a* at the time when the sleeve 43 has slid to the other side as shown in the top view of the drawing is also reduced. With this configuration, it is possible to reduce leakage of engine oil even when the width of the cam holder 22 is not especially increased.

In the above-described engine 1 according to the present embodiment, when the engine 1 includes the cam changing mechanism that changes the sets of two cams 41, 42 by sliding the corresponding cam units 4 mounted on the intake camshaft 12, the cam units 4 for the first and second cylinders 3 are integrated by the sleeve 43, and the cam units 4 for the third and fourth cylinders 3 are integrated by the other sleeve 43. With this configuration, the two cam units 4 operate as one, so cost is reduced by reducing the number of the shift pins 51 or actuators 5 for actuating the cam units 4.

The lock mechanism 6 is provided between each sleeve 43 and the intake camshaft 12. When the cam units 4 are moved to the low-lift position or the high-lift position by causing the sleeve 43 to slide, the lock balls 61 provided on the intake camshaft 12 are latched by the annular groove 48 or annular groove 49 of the sleeve 43. Thus, the lock balls 61 are positioned with respect to the intake camshaft 12.

Since the through-holes 43*a*, 43*b* for supplying engine oil in order to lubricate the lock balls 61 are provided at the same positions in the circumferential direction as the lock balls 61 in the journal portion of the sleeve 43, it is possible to stably supply engine oil to the lock balls 61 and, by extension, the lock mechanism 6, via the through-holes 43*a*, 43*b*. In the present embodiment, it is possible to stably supply engine oil particularly from the two through-holes 43*a*, 43*b* to the two lock balls 61.

Other Embodiments

The configuration of the disclosure is not limited to the above-described embodiment. The embodiment is only illustrative, and the application, and the like, of the configuration of the disclosure are, of course, not limited. For example, in the embodiment, each cam unit 4 includes the low-lift cam 41 and the high-lift cam 42 for each intake valve 10, and the lift characteristic of each intake valve 10 is switched in high and low two steps; however, the disclosure is not limited to this configuration. For example, the lift characteristic may be switched in three steps.

In the embodiment, the two lock balls 61 are arranged on the intake camshaft 12, and the two lock balls 61 are latched by the annular groove 48 or annular groove 49 of the sleeve 43 of the cam units 4; however, the disclosure is not limited to this configuration. The number of the lock balls 61 may be only one, and one or two lock balls provided on the sleeve 43 may be latched by an annular groove provided at the outer periphery of the intake camshaft 12. In addition, an engaging portion other than the lock ball may be provided, and a latching portion that latches the engaging portion is also not limited to the annular groove.

In the embodiment, when the through-holes 43*a*, 43*b* are provided at two locations in the sleeve 43, the through-holes 43*a*, 43*b* are deviated in the direction of the axis X; however, the disclosure is not limited to this configuration. The through-holes 43*a*, 43*b* may be provided at two locations at the same position in the axis X direction. Unlike the embodiment, the two through-holes 43*a*, 43*b* do not always need to communicate with the oil supply groove 22*a*.

Furthermore, in the embodiment, the example in which the cam changing mechanism is provided at the intake side in the valve actuating system for the engine 1 is described. Instead, the cam changing mechanism may be provided at the exhaust side or may be provided at both sides. As in the case of the embodiment, the in-line four-cylinder engine 1 is not limited to the case where the cam units 4 for the first and second cylinders 3 (#1, #2) are integrally coupled to each other and the cam units 4 for the third and fourth cylinders 3 (#3, #4) are also integrally coupled to each other.

For example, the disclosure is applicable to the case where the cam units 4 for the first and second cylinders 3 (#1, #2) are integrally coupled to each other in an in-line three-cylinder engine. Irrespective of the number of cylinders, the disclosure is also applicable to the case where the cam units 4 for all the cylinders 3 are individually actuated.

The engine 1 may be an in-line five or more cylinder engine. The disclosure is also applicable to not an in-line engine but also various cylinder arrangement engines, such as a V-engine.

The disclosure is able to stably lubricate a positioning mechanism even when the mechanism is provided between a camshaft and a cam unit fitted around the camshaft in a cam-changing variable valve mechanism provided in a valve actuating system for the engine, and is highly effective when applied to, for example, an engine mounted on an automobile.

What is claimed is:

1. A variable valve mechanism mounted on an engine, the variable valve mechanism comprising:

a camshaft; and a cam unit fitted around the camshaft, the cam unit including a plurality of cams, one cam of the plurality of cams configured to be selected by causing the cam unit to slide in an axial direction, wherein internal spline teeth provided at an inner periphery of a sleeve of the cam unit are in mesh with external spline teeth provided at an outer periphery of the camshaft, a dent ball is provided at one of the inner periphery of the sleeve and the outer periphery of the camshaft, the dent ball is configured to retractably project toward a remaining one of the inner periphery of the sleeve and the outer periphery of the camshaft, an annular groove provided at the remaining one of the inner periphery of the sleeve and the outer periphery of the camshaft, the annular groove is configured to latch the dent ball, and the sleeve has a through-hole provided at a same position in a circumferential direction as the dent ball, the through-hole is configured to supply the inner periphery of the sleeve with lubricating oil that is supplied to an outer periphery of the sleeve.

2. The variable valve mechanism according to claim 1, wherein the engine includes a plurality of cylinders, the sleeve extends over two adjacent cylinders, a journal portion that is held by a cam holder is provided between the two adjacent cylinders, and the through-hole is provided in the journal portion so as to communicate with a circumferential groove that opens to an inner periphery of the cam holder.

3. The variable valve mechanism according to claim 2, wherein the dent ball is provided on the sleeve or the camshaft at two locations spaced apart from each other in the circumferential direction, and the through-hole including two-through holes respectively provided at locations spaced apart from each other in the circumferential direction in correspondence with the two locations at which the dent ball is provided.

4. The variable valve mechanism according to claim 3, wherein the annular groove is provided all around the camshaft or the sleeve, and the two through-holes are provided so as to be offset from each other in the axial direction of the camshaft.

5. The variable valve mechanism according to claim 4, wherein a location of the two through-holes in the axial direction of the camshaft partially overlap each other.

6. The variable valve mechanism according to claim 4, wherein an amount of the offset between the two through-holes in the axial direction is smaller than a radius of each of the two through-holes.

7. The variable valve mechanism according to claim 4, wherein at least one of the two through-holes constantly communicates with the circumferential groove.

* * * * *